United States Patent [19]

Steinmann, Jr.

[11] 4,073,181

[45] Feb. 14, 1978

[54] AUTOMOBILE BODY DENT PULLER TOOL

[76] Inventor: Eugene B. Steinmann, Jr., 9140 Fountainbleau Blvd., Apt. 402, Miami, Fla. 33172

[21] Appl. No.: 589,378

[22] Filed: June 23, 1975

[51] Int. Cl.[2] ..... B21D 1/12

[52] U.S. Cl. ..... 72/479; 72/705; 173/132

[58] Field of Search ..... 72/705, 479; 173/91, 173/114, 116, 132, 133, 121

[56] References Cited

U.S. PATENT DOCUMENTS

| | | | |
|---|---|---|---|
| 152,391 | 6/1874 | Manson | 173/132 X |
| 1,292,429 | 1/1919 | Bull | 173/132 X |
| 1,604,958 | 11/1926 | Bayles | 173/132 X |
| 2,561,577 | 7/1951 | Knudsen | 173/132 |
| 3,030,837 | 4/1962 | Chartier | 72/705 X |
| 3,273,657 | 9/1966 | Willems et al. | 173/121 |
| 3,511,325 | 5/1970 | Schmidt | 173/91 X |
| 3,570,289 | 3/1971 | Smyers | 72/705 X |
| 3,922,902 | 12/1975 | Jarman | 72/453 |

*Primary Examiner*—C.W. Lanham
*Assistant Examiner*—D. M. Gurley
*Attorney, Agent, or Firm*—Ernest H. Schmidt

[57] ABSTRACT

A pneumatically driven, impact-actuated auto body dent puller has a cylindrical slide weight coaxially movable along a slide shaft for impact against an abutment collar near one end thereof, the slide member being slidably enclosed within a tubular cylinder member having free fitting caps at each end and provided with a through opening near one end connected with a manually controlled valve for impressing a blast of pressurized air behind the slide weight when disposed at the forward end of the slide shaft for projecting the slide weight rearwardly against the abutment collar through the interposed rear end cap, thereby imposing a rearward striking force upon a sheet-metal screw secured at the forward end of the slide shaft which is removably receivable within a punched opening in the dented zone of an area of sheet metal to be repaired.

3 Claims, 3 Drawing Figures

AUTOMOBILE BODY DENT PULLER TOOL

This invention relates to automotive body repair work and is directed particularly to a pneumatically-actuated dent puller which substantially reduces the effort required of the mechanic in use of the tool as compared with manually actuated sliding weight impact dent pullers heretofore devised.

In the repair of damaged automotive vehicle bodies, the first step in the reshaping of indented zones is to bring the indented sheet metal as nearly as practicable back into its original shape, that is, into a plane substantially coincident with that of the surrounding undamaged area. While this can usually be easily done in sheet metal body areas to which access can be had from behind, such as in fender, hood and trunk door panel zones, for example, by hammering out indented zones with the use of appropriate dollies, this method is not as readily adaptable to outer door panels and the like to which access from behind can only be had after disassembly of substantial portions of interior structure. To overcome this time-consuming difficulty in the repair of dented exterior door panels and the like to which access to the rear can be had only with difficulty, various methods have been devised for attaching a tool to a dented portion from the outside thereof so that it can be pulled back into substantially the original shape from the outside of the panel. One class of tools heretofore provided comprises a shaft having a handle at one end, a screw connector at the other end adapted to be force-threaded into a small hole punched in the dented zone to be refaced, and a weight slidably disposed along the shaft and adapted to be manually slid from the outer to the inner or handle end of the shaft to strike against an abutment thereat, whereupon the force of impact impressed along the shaft serves to pull the connected dented sheet metal outwardly. Such impact actuated tools as have heretofore been devised, however, particularly when used for long periods of time in the removal of large dents, necessitate the expenditure of considerable energy on the part of the tool operator, and are therefore often times fatiguing to use. It is, accordingly, the principal object of this invention to provide a novel and improved pneumatically-driven, impact-actuated dent puller that is comparatively easy to use, even over extended periods of time as may be required in the repair of large auto body sheet metal dents.

Another object of the invention is to provide a pneumatically-driven auto body dent puller of the character described wherein the slide weight is of cylindrical shape and is enclosed for sliding within a tubular chamber the ends of which are enclosed by skirted cap members slidingly received over the opposite ends of the peripheral cylindrical wall so as to permit the limited relative movement incident to the forces of impact imposed upon the tool assembly each time the sliding weight strikes the abutment means of the handle end of the slide shaft.

Yet another object of the invention is to provide a dent puller attachment device of the above nature which will be simple in structure, economical to manufacture, effective in operation and long wearing in use.

Other objects, features and advantages of the invention will be apparent from the following description when read with reference to the accompanying drawings. In the drawings, wherein like reference numerals denote corresponding parts throughout the several views.

Figure 1:
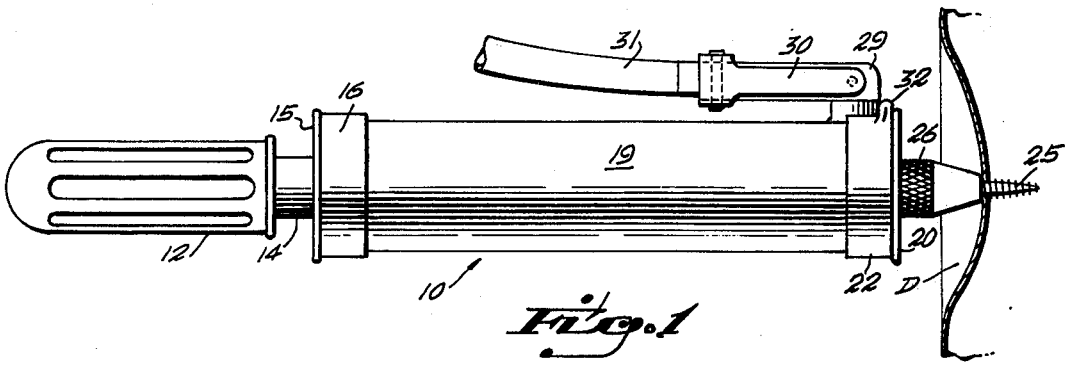
FIG. 1 illustrates, in side view, an automobile body dent puller tool embodying the invention, shown attached to a sheet metal dent to be pulled.

Referring now in detail to the drawings, the pneumatically-actuated automobile body dent puller tool, generally indicated by reference numeral 10, comprises an elongate slide shaft 11 having a handle 12 at one end and being screw threaded for a short distance along the front end as indicated at 13. An annular impact collar 14 is securely fixed to the slide shaft 11 in front of the handle 12, such as welding in place. A cylindrical end cap 15 having a forwardly-extending peripheral skirt 16 and a central opening 17 is circumjacently disposed on the slide shaft 11 in abutting relationship with respect to the impact collar 14. The end wall of the end cap 15 is provided with a plurality of circularly-arranged, through openings 18 for the free passage of air, as hereinbelow more particularly described.

Slide-fitted within the skirt 16 of the end cap 15, is the rear end of a tubular cylinder member 19 circumjacently disposed on the slide shaft 11. The front end of the tubular cylinder member 19 is enclosed by a front end cap 20 having a central opening 21 for the reception of the threaded front end portion 13 of the slide shaft 11 and a rearwardly-directed skirt 22 slidingly disposed over said front end of said tubular cylinder member.

The inner surface of the front end cap 20 abuts a stop nut 23 threaded on the screw-threaded front end portion 13 of the slide shaft 11, said stop nut being adjustably locked in place from behind by a jam nut 24.

Figure 2:
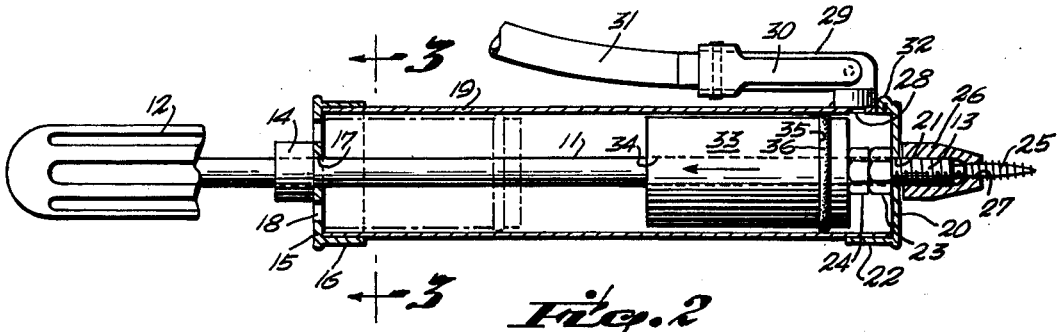
FIG. 2 is a side view similar to that of FIG. 1, but partly in longitudinal cross-section to illustrate constructional details.
Figure 3:
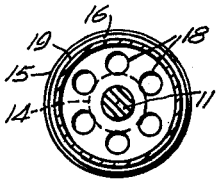
FIG. 3 is a vertical cross-sectional view taken along the line 3—3 of FIG. 2 in the direction of the arrows.

Means is provided for replaceably securing a self-tapping screw 25 in coaxial, outwardly-extending relation with respect to the front end of the slide shaft 11. To this end, an internally-threaded cap nut 26 is provided, having a central opening 27 of substantially lesser diameter than that of the interior threaded bore of said cap nut to define an interior annular shoulder against which the underside of the head portion of the self-tapping screw 25 can be seated. As illustrated in FIG. 2, the stop nut 23 is so positioned along the threaded front end portion of the slide shaft 11, that upon tightening the cap nut 26 in place, the self-tapping screw 25 can be clamped against the outer end of said slide shaft without at the same time clamping the front end cap 20 against the stop nut 23. The front end cap 20 will thus be afforded the possibility of limited rotational and longitudinal movement with respect to the slide shaft 11 to minimize any possibility of distortion of the tubular enclosure parts during operation of the tool, as is hereinbelow more particularly described.

The tubular cylinder member 19 is provided, near its front end, with a through opening 28 against the outside of which is securely affixed, as by welding thereto, a pressurized air release valve 29 having manually-operated air release control bar 30. The air release valve 29 is fed through a flexible hose 31 (partially illustrated) with a source of pressurized air (not illustrated). As illustrated in FIGS. 1 and 2, the skirt 22 of the front end cap 20 is so shaped, as indicated at 32, as to provide a recess for the reception of that portion of the air release valve 29 abutting the tubular cylinder member 19 at the cylindrical opening 28 therein.

Slidably disposed on the slide shaft 11 within the tubular cylinder member 19, is a cylindrical slide weight 33, having an axial opening 34 of slightly greater diameter than that of said slide shaft. The outer diameter of the cylindrical weight 33 is somewhat less than that of the internal diameter of the tubular cylinder member 19, and is provided, near its front end, with an annular groove 35 within which is seated an O-ring 36 in sliding contact with the interior peripheral wall of said tubular cylinder member.

In the use of my dent puller tool, sheet metal dents D will first be provided with punched openings within and along the zone of indentation, appropriately spaced therein for successive dent pulling operations as hereinbelow described. These punched openings will be of such diameter as to permit attachment or connection of the self-tapping screw 25 when screw threaded therein by use of the handle 12 at the outer end of the slide shaft 11. After the self-tapping screw 25 has thus been engaged, as illustrated in FIG. 1 for example, the tool operator will actuate the device by pressing down on the control bar 30 of the air release valve 29, whereupon a blast of air under pressure will be applied through the opening 28 in the tubular cylinder member 19 at the forward end of the cylindrical slide weight 34. The weight will thereupon be sharply driven from the forward position as illustrated by the full-line representation thereof in FIG. 2, to the broken-line representation thereof at the rear end of the cylinder member 19, whereat it strikes against the impact collar 14 through the relatively free end cap 15. This sudden impact of the cylindrical slide weight serves to drive the slide shaft 11 in the rearward direction, carrying with it a portion of the dented sheet metal being operated upon. This operation can be repeated at the same location as many times may be necessary to achieve the desired withdrawal of that portion of the dent, whereafter the tool will similarly be applied to other zones of the dent and repeatedly actuated as described above to approximate the original contour of the sheet metal. Return of the slide weight to its forward limit position in the tubular cylinder 19 after each impact operation can readily be accomplished simply by tilting the slide shaft 11 upwardly to allow it to slide forward again under the force of gravity. In this connection it will be noted that the cylindrical slide weight 33 and its associated O-ring fit freely enough within the tubular cylindrical member 19 as to allow the escape of air trapped within the forward end of the cylinder during the relatively slow return of said weight to its forward position. The multiple openings 18 in the end cap 15 at the same time offer substantially no resistance to the outward passage of air in the rear end of the tubular cylinder member 19 upon the rapid movement of the cylindrical slide weight 33 in the impact or outward direction.

It is also to be noted that the comparatively free fit of the end caps 15 and 20 over their respective ends of the tubular cylinder member 19 prevents the imposition of such impact stresses upon the slide cylinder assembly as might otherwise distort and damage it over long periods of use.

While I have illustrated and described herein only one form in which my invention can conveniently be embodied in practice, it is to be understood that this form is presented by way of example only and not in a limiting sense. The invention, in brief, comprises all the modifications and embodiments coming within the scope and spirit of the following claims.

What I claim as new and desire to secure by Letters Patent is:

1. A pneumatically-driven auto-body dent puller comprising in combination, a slide shaft, a handle at one end of said slide shaft, means for removably securing a self-tapping screw at the other end of said slide shaft, a cylindrical slide weight having a coaxial bore through which said slide shaft is slidingly received, impact abutment means at the handle end of said slide shaft, a tubular cylinder member concentrically disposed about said slide shaft, a pair of front and rear end cap members centrally apertured for the through passage of said slide shaft and arranged thereon for enclosing the front and rear ends, respectively, of said tubular cylinder member, the outer diameter of said cylindrical slide weight being slightly less than the internal diameter of said tubular cylinder member to permit free sliding movement thereof along said slide shaft and within said tubular cylindrical member, and means for injecting a blast of pressurized air within the front end of said cylinder member forwardly of said cylindrical slide weight while in a forward position within said cylinder to drive said cylindrical slide weight rearwardly for impact against said impact abutment means through said rear end cap member, said end cap members each being provided with peripheral skirt portions slidingly receiving respective end portions of said tubular cylinder member, and vent means in said rear end cap member for discharge therethrough of air in said cylinder displaced upon said rearward driving movement of said slide weight.

2. A pneumatically driven auto-body dent puller as defined in claim 1, wherein said impact abutment means comprises an abutment collar fixed with respect to said slide shaft directly behind said rear cap member.

3. A pneumatically driven auto-body dent puller as defined in claim 2, wherein said slide weight is provided near its forward end with an annular groove, and an O-ring seated within said groove for sliding contact within said tubular cylindrical member.

* * * * *